United States Patent [19]

Cinotti

[11] Patent Number: 4,877,367

[45] Date of Patent: Oct. 31, 1989

[54] APPARATUS FOR THE AUTOMATIC SEPARATION INTO REAMS OF A STACK OF LARGE FORMAT SHEETS OF PAPER THE REAM DIVISIONS OF WHICH ARE COUNTED OFF PREVIOUSLY AND INDICATED BY MARKERS

[75] Inventor: Andrea Cinotti, Bologna, Italy

[73] Assignee: Wrapmatic S.p.A., Bologna, Italy

[21] Appl. No.: 120,827

[22] Filed: Nov. 16, 1987

[30] Foreign Application Priority Data

Dec. 16, 1986 [IT] Italy ..... 3609 A/86

[51] Int. Cl.[4] ..... B65H 3/50

[52] U.S. Cl. ..... 414/796; 414/796.8

[58] Field of Search ..... 414/114, 115, 119, 786, 414/796, 796.8

[56] References Cited

U.S. PATENT DOCUMENTS

| | | | |
|---|---|---|---|
| 3,055,516 | 9/1962 | Mead | 414/114 |
| 3,155,244 | 11/1964 | Rogers et al. | 414/115 |
| 3,176,859 | 4/1965 | Prager | 414/114 |
| 3,206,042 | 9/1965 | Peterson | 414/114 |
| 3,701,441 | 10/1972 | Gudler | 414/114 |
| 4,620,827 | 11/1986 | Sameshima et al. | 414/114 |
| 4,623,292 | 11/1986 | Suzuki et al. | 414/114 |

FOREIGN PATENT DOCUMENTS

| | | | |
|---|---|---|---|
| 147319 | 7/1985 | European Pat. Off. | 414/114 |

*Primary Examiner*—Frank E. Werner
*Assistant Examiner*—Janice Krizek
*Attorney, Agent, or Firm*—Laff, Whitesel, Conte & Saret

[57] ABSTRACT

An apparatus includes pincers, or suckers, that tension each marker at an angle to the stack of sheets from which it emerges, and a separator mechanism; the separator incorporates a follower with a tapered leading edge that is offered to the taut marker, and a support, to which the follower is hinged, that can be moved from a retracted position to an extended position in which the follower penetrates the stack of sheets, sliding in between the marker and the ream sitting on and separated by the marker.

5 Claims, 3 Drawing Sheets

FIG2
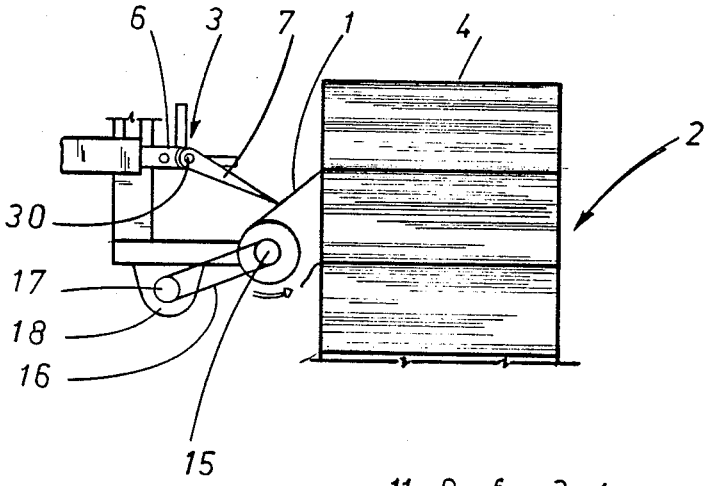
FIG3
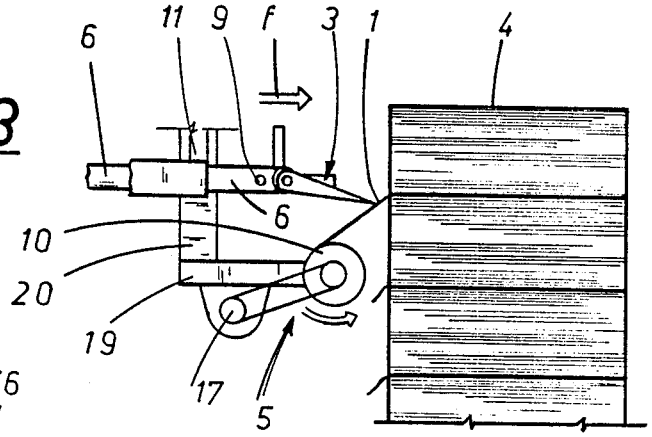
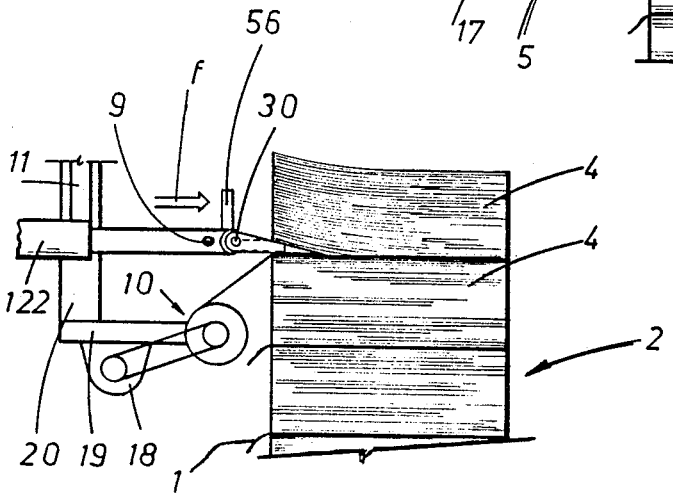
FIG4

APPARATUS FOR THE AUTOMATIC SEPARATION INTO REAMS OF A STACK OF LARGE FORMAT SHEETS OF PAPER THE REAM DIVISIONS OF WHICH ARE COUNTED OFF PREVIOUSLY AND INDICATED BY MARKERS

BACKGROUND of the INVENTION

The invention disclosed relates to an apparatus and a method for the automatic separation of stacked sheets of large format paper into reams, designed for use in applications where the sheets are counted off previously into reams, using markers.

In the art field embracing the manufacture of paper in reams of large format sheets for designers, artists etc., a problem typically encountered with the wrapping operation is that of how the stack of single sheets is separated into reams.

Reams destined for wrapping by the machine are discharged by the sheeter onto a pallet in a simple stack of single sheets; the pallet is placed on an elevator platform which ascends automatically every time the operator removes a ream, in such way that handling occurs at an unvarying height.

Substantially two basic conventional methods are used for separating the stack of sheets into reams.

The first such method makes use of an instrument similar to a gage, with two measuring arms, one of which fixed and provided with a locator, the other mobile and fitted with a blade designed to penetrate between adjacent sheets. The operator calculates the depth of the ream on the basis of the number and the thickness of the single sheets, then, offering the fixed locating arm to the top sheet, slides the gage forward to the point where the blade inserts between two sheets at the selected depth, and thus separates the ream from the remainder of the stack beneath.

In the second method, the stack of sheets from which the reams are formed is prepared by a machine that counts off the sheets and interposes a marker between one sheet and the next each time the count is completed; the marker is nothing other than a piece of paper or some other material, colored or otherwise, that protrudes from the stack, and the operator simply has to lift off the sheets that lie above the marker and supply them to the wrapping machine.

This second method is extremely precise, though the markers do not always fall in the same position, a drawback attributable to differences both in the size of sheet being handled, and in the features of the various types of sheeter used in manufacture.

At all events, separation of the stack of sheets into reams, in either of the methods thus described, remains a manually-implemented process.

Accordingly, the object of the invention is to provide an apparatus capable of receiving a stack of sheets and separating it into reams automatically.

A further object of the invention is to embody an apparatus that will be capable of achieving this main object in an economical and functional manner.

SUMMARY OF THE INVENTION

The stated object is achieved with an apparatus as described and claimed herein, which is provided with means for gripping and tensioning the markers, and with a separator mechanism that incorporates a follower, hinged to a support that can be moved in toward and away from the stack of sheets.

According to the invention, the pivoted follower is caused to slide along each marker in turn, to the point of penetrating the stack.

One advantage of the invention is the facility it affords of effecting an ultra-precise separation of bulk large format sheets into reams in readiness for transfer to a wrapping machine.

A further advantage of the apparatus disclosed is that of its simple constructional embodiment, a factor bringing singular benefits in terms of cost and practical application.

BRIEF DESCRIPTION of the DRAWINGS

The invention will now be described in detail, by way of example, with the aid of the accompanying drawings, in which:

FIGS. 2, 3 and 4 are further schematic illustrations, viewed in side elevation with certain parts cut away better to reveal others, in which the apparatus is seen in various configurations during the work cycle proper.

DESCRIPTION of the PREFERRED EMBODIMENT

With reference to FIGS. 2, 3 and 4, the method of the invention comprises the steps of:

gripping each marker 1, and tensioning it at an angle in relation to the stack of sheets 2 (FIG. 2);

offering a separator mechanism 3 to the tautened marker 1 (FIG. 3) and sliding it forward, using the marker as a guide, to the point of penetrating the stack of sheets 2 (FIG. 4).

A preferred version of the method will include the additional step of blowing compressed air from the sides of the separator mechanism once inserted into the stack of sheets 2.

Figure 1:
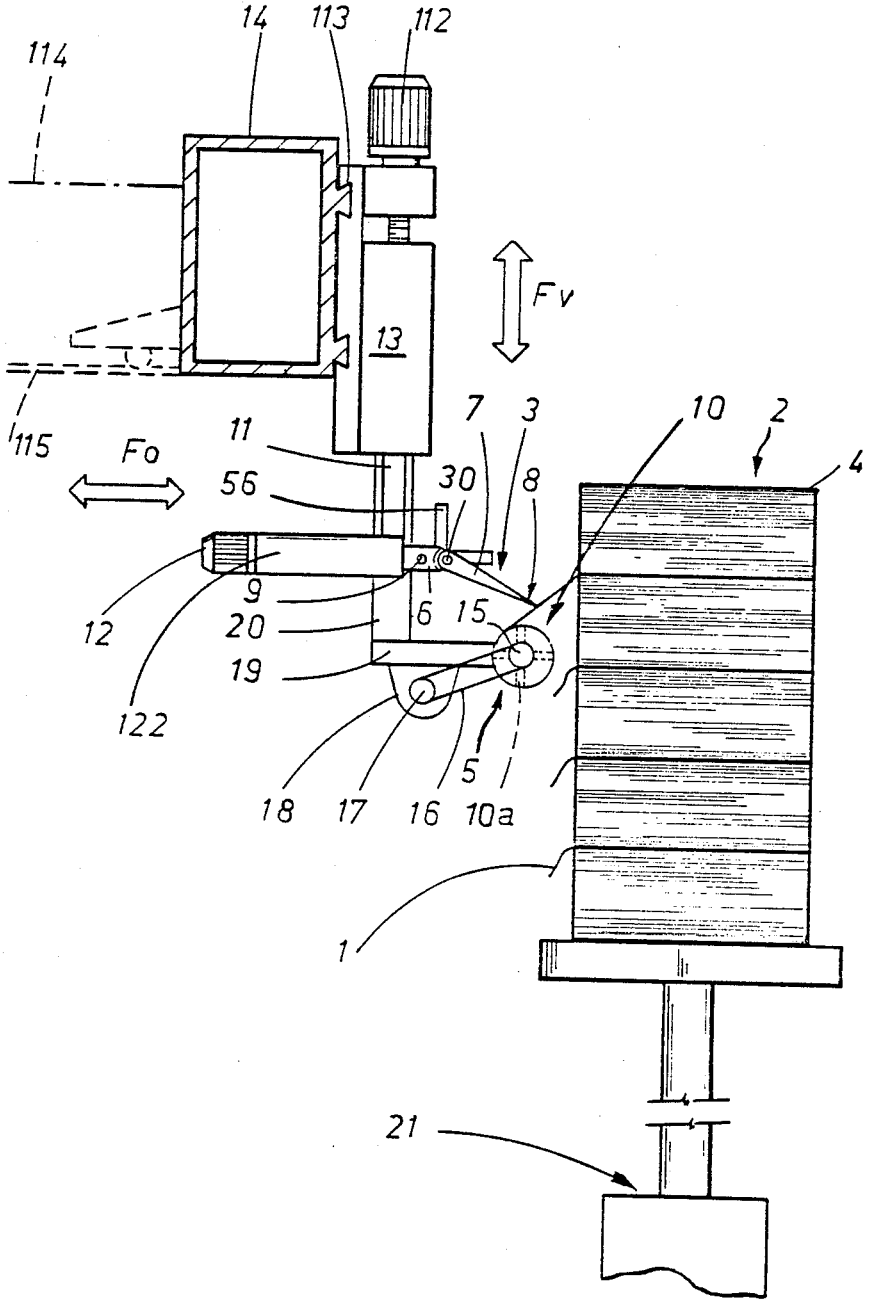
FIG. 1 is a schematic representation of the apparatus disclosed, viewed in side elevation with certain parts cut away better to reveal others, illustrated in the configuration immediately preceding its work cycle.

With reference to FIG. 1, an apparatus according to the invention capable of implementing the steps as described above comprises:

means, denoted 5, for gripping and tensioning the markers 1; and a separator mechanism, denoted 3.

The separator mechanism 3, which is directed at the stack of sheets 2, consists in a support 6, and a follower 7. The support 6 is associated with a vertical slide 11, in relation to which it is able to traverse back and forth horizontally (arrow Fo) between a retracted at-rest position (FIG. 1) and an extended operating position, propelled by drive means 12 (FIG. 4). In detail, the support 6 is horizontally slidably movable into a support guide 122 connected to the vertical slide 11.

The slide 11 is capable of movement through the vertical direction (arrow Fv) within the axial bore of a guide 13 carried by a horizontal rail 14, and is adjustable for position therein; 112 denotes second drive means by which the slide is operated. The guide 13 is also adjustable for position along horizontal ways 113 within a plane perpendicular to that occupied by each of the single sheets of paper.

The follower 7 is tapered down toward the end 8 offered to the stack of sheets 2, and hinged to the support 6; in the preferred embodiment illustrated (see FIG. 1), the wider end of the follower 7 pivots on a hinge pin 30 located at the end of the support 6 nearest the stack of sheets 2.

The separator mechanism 3 incorporates holes 9 connected to a supply of compressed air, by which an air cushion effect can be created between the ream 4 and the remainder of the stack of sheets 2 from which the ream is separated. Such holes 9 might be formed in the support 6, as in the example of FIG. 1, or at the sharp edge of the follower 7, which would be preferable to the end of producing a well-defined cushion.

Gripping and tensioning means 5 are embodied in the form of a revolving drum 10 incorporating peripheral holes 10*a* that connect, by way of a conventional rotary device with suction means (not illustrated). The drum 10 is keyed to a small pulley 15 about which a belt 16 is looped; the same belt is passed around a further pulley 17 keyed to the spindle of a motor 18.

The gripping and tensioning means 5 are mounted to a bracket 19 which is made fast to an extension 20 of the slide 11; with this arrangement, the distance between the gripping and tensioning means 5 and the separator mechanism 3 remains fixed, and can also be selected to best advantage.

Figure 5:
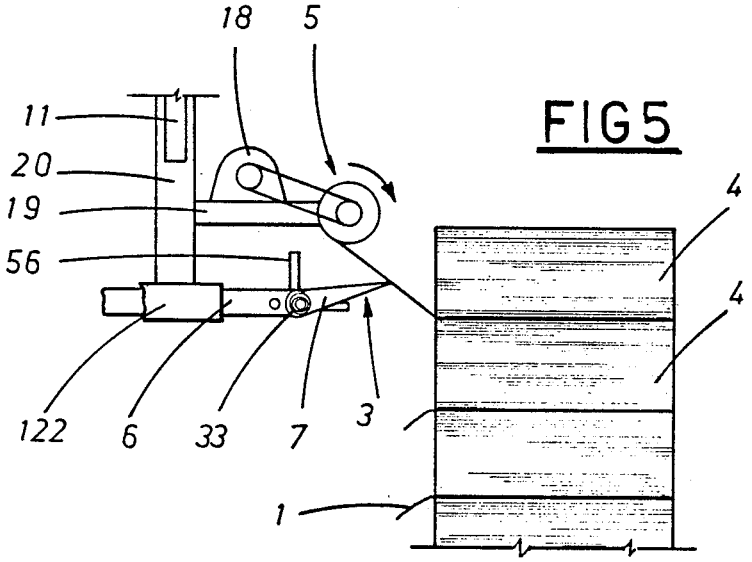
FIGS. 5 and 6 show the apparatus with two different solutions relating to particular elements thereof.

Gripping and tensioning means 5 can be installed either below, or above the separator mechanism 3. In the first instance (see FIG. 1), the pivoted follower 7 will be able to function subject to the sole force of mass, whereas in the second (see FIG. 5), it must be operated in conjunction with a spring 33 coaxially disposed with respect to the hinge pin 30; and arranged in such a way as to bias the follower 7 upwards, at a given angle.

Operation of the apparatus disclosed remains exactly same in respect of the method described at the outset, whatever the position of the gripping and tensioning means 5: if installed above the level of the separator mechanism 3, the follower 7 will be angled normally upwards under the spring bias 33, and turn gradually down toward the horizontal in the face of the resistance offered by the marker 1 once tautened by the gripping and tensioning means 5.

The inclusion of the vertical slide 11 provides the facility of adjusting the working height of the gripping and tensioning means 5 and the separator mechanism 3 to match the depth of the ream 4, and the height to which the stack of sheets 2 is indexed by elevator means, denoted 21, each time a ream 4 is removed.

By altering the position of the guide 13 along the ways 113 of the horizontal rail 14 it becomes possible to align the gripping and tensioning means 5 and the separator mechanism 3 with the markers 1, which will be inserted regularly at a given location according to the size of the sheets and to the type of sheeter by which the stack 2 is turned out. Such an adjustment might be effected either manually, or automatically, utilizing means of the same type as those denoted 12 and 112.

The position of the markers 1 issuing from the stack of sheets 2 is important inasmuch as it will determine the position of the apparatus (the markers might emerge at the front of the stack, as in the example illustrated, or from either side), although such a contigency clearly imposes no limitation on the scope of the invention as claimed.

It is worth remarking however, that in the event of the markers 1 lying parallel to the direction f in which the reams 4 are transferred to a downstream wrapping machine, the support 6 of the separator mechanism 3 is provided with pushing means realized in the form of a projection 56 located above and/or offset from the follower 7 in the transverse plane, and the rail 14 could be made mobile in the broadways direction, driven by chains 114 and running on tracks 115, in such a way that the apparatus can serve additionally to effect transfer of the reams 4 in the direction f aforementioned be means of the said projection 56.

Figure 6:
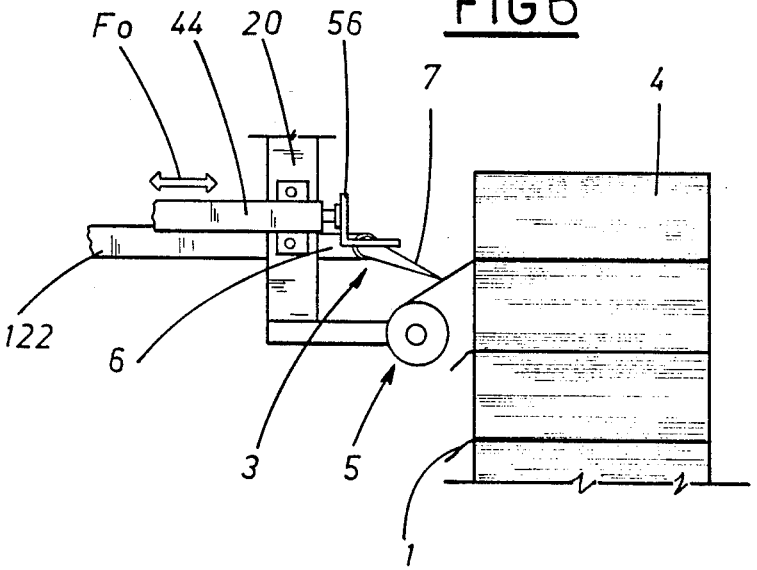

In the case illustrated in FIG. 1, on the other hand, the projection 56 will be rigidly attached to the support 6 just power driven by the motor 12. Otherwise, as illustrated in FIG. 6, said pushing means 56 are associated independently with means of propulsion 44 operating through the $F_o$ direction.

What is claimed:

1. An apparatus for the automatic separation into reams of a large format sheet stack of paper the ream divisions of which are counted off previously and indicated by markers inserted into said sheets so that a portion of said marker is outside of a side of said sheet stack comprising:

gripping means able to grip each marker and simply tension it at an angle in relation to the sheet stack;

a non-suction separator mechanism vertically disposed with respect to the gripping means, said separator consisting in a follower, exhibiting a tapered projecting end that is designed to enter into contact with each marker and thereafter to penetrate easily into the sheet stack hinged to a support horizontally movable once the marker is gripped and taut, among a retracted position in which the follower is distanced from the marker, through intermediate positions in which the follower touches and follows the gripped marker along its bare portion, and at least one extended position in which the follower penetrates into the sheet stack causing a lifting of the separating uppermost sheet stack ream;

pushing means able to horizontally distance the separated ream from the stack and operate through the direction of said separator mechanism; and said gripping means being located on a level below that of the separator mechanism, and the follower of the separator mechanism pivots freely about the support to follow the gripped marker by gravity.

2. An apparatus for the automatic separation into reams of a large format sheet stack of paper the ream divisions of which are counted off previously and indicated by markers inserted into said sheets so that a portion of said marker is outside of a side of said sheet stack comprising:

gripping means able to grip each marker and simply tension it at an angle in relation to the sheet stack;

a non-suction separator mechanism vertically disposed with respect to the gripping means, said separator consisting in a follower, exhibiting a tapered projecting end that is designed to enter into contact with each marker and thereafter to penetrate easily into the sheet stack hinged to a support horizontally movable once the marker is gripped and taut, among a retracted position in which the follower is distanced from the marker, through intermediate positions in which the follower touches and follows the gripped marker along its bare portion, and at least one extended position in which the follower penetrates into the sheet stack causing a lifting of the separating uppermost sheet stack ream;

pushing means able to horizontally distance the separated ream from the stack and operate through the direction of said separator mechanism; and said gripping means consisting in a revolving drum disposed on the other side of the separator mechanism with respect to the gripped marker and incorporating peripheral holes connected with suction generating means.

3. An apparatus for the automatic separation into reams of a large format sheet stack of paper the ream divisions of which are counted off previously and indicated by markers inserted into said sheets so that a portion of said marker is outside of a side of said sheet stack comprising:

gripping means able to grip each marker and simply tension it at an angle in relation to the sheet stack;

a non-suction separator mechanism vertically disposed with respect to the gripping means, said separator consisting in a follower, exhibiting a tapered projecting end that is designed to enter into contact with each marker and thereafter to penetrate easily into the sheet stack hinged to a support horizontally movable once the marker is gripped and taut, among a retracted position in which the follower is distanced from the marker, through intermediate positions in which the follower touches and follows the gripped marker along its bare portion, and at least one extended position in which the follower penetrates into the sheet stack causing a lifting of the separating uppermost sheet stack ream;

pushing means able to horizontally distance the separated ream from the stack and operate through the direction of said separator mechanism; and the support of the separator mechanism is slidably accommodated into a support guide connected to a vertical slide adjustable with respect to the gripping means.

4. An apparatus for the automatic separation into reams of a large format sheet stack of paper the ream divisions of which are counted off previously and indicated by markers inserted into said sheets so that a portion of said marker is outside of a side of said sheet stack comprising:

gripping means able to grip each marker and simply tension it at an angle in relation to the sheet stack;

a non-suction separator mechanism vertically disposed with respect to the gripping means, said separator consisting in a follower, exhibiting a tapered projecting end that is designed to enter into contact with each marker and thereafter to penetrate easily into the sheet stack hinged to a support horizontally movable once the marker is gripped and taut, among a retracted position in which the follower is distanced from the marker, through intermediate positions in which the follower touches and follows the gripped marker along its bare portion, and at least one extended position in which the follower penetrates into the sheet stack causing a lifting of the separating uppermost sheet stack ream;

pushing means able to horizontally distance the separated ream from the stack and operate through the direction of said separator mechanism; and the gripping means and the separator mechanism are rigidly associated one with the other, and the pushing means are associated independently with horizontally operating drive means.

5. Apparatus as in claim 4, wherein pushing means consist in a projection issuing rigidly from a slide capable of movement in a vertical direction through the agency of drive means, and means for their propulsion consist in a horizontal transverse rail, to which the slide is connected, that runs on tracks and travels in the direction in which the reams are distanced from the stack.

* * * * *